US011306593B2

(12) United States Patent
Abenhaim et al.

(10) Patent No.: US 11,306,593 B2
(45) Date of Patent: Apr. 19, 2022

(54) KEY WASHER FOR A GAS TURBINE ENGINE

(71) Applicant: PRATT & WHITNEY CANADA CORP., Longueuil (CA)

(72) Inventors: Acher-Igal Abenhaim, Cote Saint Luc (CA); Vincent Paradis, Longueuil (CA); Marc-Antoine Mailloux-Labrousse, Montreal (CA); Alexander Smith, Montreal (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 86 days.

(21) Appl. No.: 16/558,951

(22) Filed: Sep. 3, 2019

(65) Prior Publication Data

US 2021/0062656 A1 Mar. 4, 2021

(51) Int. Cl.
*F01D 5/06* (2006.01)
*F01D 25/00* (2006.01)

(52) U.S. Cl.
CPC ..... *F01D 5/06* (2013.01); *F01D 25/00* (2013.01); *F05D 2240/24* (2013.01)

(58) Field of Classification Search
CPC ..... F01D 5/06; F01D 25/00; F05D 2240/24; F05D 2260/36; F05D 2240/126
See application file for complete search history.

(56) References Cited

U.S. PATENT DOCUMENTS

| | | | | |
|---|---|---|---|---|
| 6,059,486 | A | 5/2000 | Latulipe | |
| 6,406,263 | B1 * | 6/2002 | Meacham | F01D 5/025 416/194 |
| 10,077,716 | B2 | 9/2018 | Anglin et al. | |
| 2015/0361901 | A1 * | 12/2015 | Anglin | F02C 3/073 60/805 |
| 2020/0131910 | A1 * | 4/2020 | Juh | F01D 5/026 |

* cited by examiner

*Primary Examiner* — Aaron R Eastman
(74) *Attorney, Agent, or Firm* — Norton Rose Fulbright Canada

(57) ABSTRACT

A gas turbine engine comprising: a shaft about an axis; a first turbine assembly mounted to the shaft, a first flow path and a second flow path extending through first turbine assembly along the axis. The second flow path is located radially inward of the first flow path relative to the axis. A second turbine assembly is about the axis downstream of the first turbine assembly, with a gap defined between the first turbine assembly and the second turbine assembly, the gap in fluid communication with the first flow path and the second flow path. A washer is downstream of the first turbine assembly. The washer has an annular body including a deflector between the first turbine assembly and the second turbine assembly, the deflector obstructing the first flow path and extending toward the second flow path.

18 Claims, 3 Drawing Sheets

KEY WASHER FOR A GAS TURBINE ENGINE

TECHNICAL FIELD

The application relates generally to gas turbine engines and, more particularly, to key washers for turbine assemblies of gas turbine engines.

BACKGROUND OF THE ART

Operation of gas turbine engines results in temperatures that may vary from ambient at the inlet to well above 1000 C downstream therefrom, for example inside the combustion section. Conventionally, cooling systems are used to compensate for combustion temperatures exceeding that which some components of the engine are designed to endure. For instance, a turbine rotor may be cooled by circulating air from relatively cooler portions of the engine, either axially through its hub or radially along its disc. Nonetheless, thermal gradients occur across some engine components, resulting in stresses that may undesirably affect engine efficiency and component life. Moreover, in practice, these thermal gradients may vary over the life of the engine, both in terms of location and magnitude. Improvements are therefore desirable.

SUMMARY

In accordance with an embodiment, there is provided a gas turbine engine comprising: a shaft about an axis; a first turbine assembly mounted to the shaft, a first flow path and a second flow path extending through first turbine assembly along the axis, the second flow path located radially inward of the first flow path relative to the axis; a second turbine assembly about the axis downstream of the first turbine assembly, with a gap defined between the first turbine assembly and the second turbine assembly, the gap in fluid communication with the first flow path and the second flow path; and a washer downstream of the first turbine assembly, the washer having an annular body including a deflector between the first turbine assembly and the second turbine assembly, the deflector obstructing the first flow path and extending toward the second flow path.

In accordance with another embodiment, there is provided a method of redirecting a flow in a gas turbine engine, the method comprising: directing a first flow through a first flow path of a first turbine disc along an axis of the gas turbine engine; directing a second flow through a second flow path of the first turbine disc inward the first flow path relative to the axis along the axis; and deflecting the first flow downstream of the first turbine disc to direct the first flow toward the second flow downstream of the first turbine disc.

In accordance with yet another embodiment, there is provided a washer for a gas turbine engine, the washer comprising: a first ring portion; at least one first keying feature extending outwardly from a peripheral surface of the first ring portion; at least one second keying feature extending from an upstream surface of the first ring portion transverse to the peripheral surface; and a second ring portion radially inward of the first ring portion, the second ring portion defining a deflector surface transverse to an axis of the first ring portion.

DESCRIPTION OF THE DRAWINGS

Reference is now made to the accompanying figures in which.

DETAILED DESCRIPTION

Figure 1:
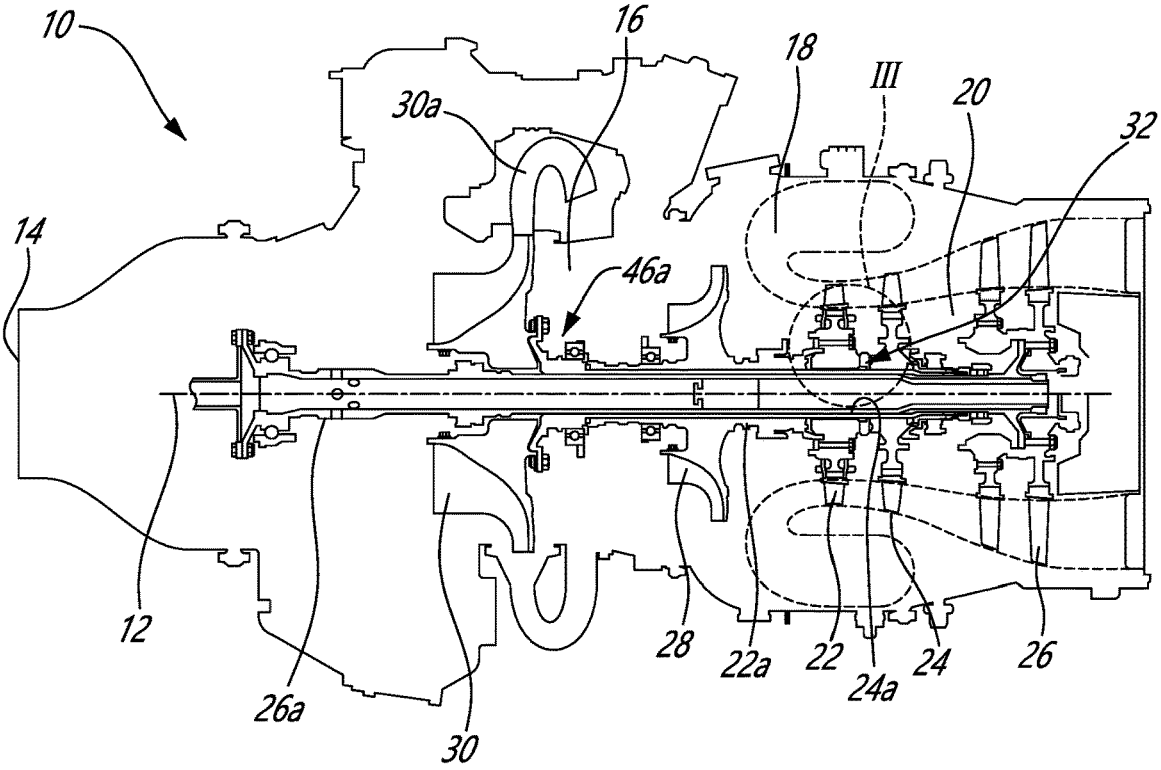
FIG. 1 is a schematic cross-sectional view of a gas turbine engine featuring a key washer in accordance with the present disclosure.

FIG. 1 illustrates a gas turbine engine 10 of a type preferably provided for use in subsonic flight, generally comprising in serial flow communication along an axis 12 of the engine 10 an inlet section 14 through which ambient air enters the engine 10, a compressor section 16 for pressurizing the air, a combustion section 18 in which pressurized air is mixed with fuel and ignited for generating an annular stream of hot combustion gases, and a turbine section 20 for extracting energy from the combustion gases. In this embodiment, the turbine section 20 includes a first turbine 22, a second turbine 24 and a power turbine 26. Other embodiments with fewer or more turbines are possible. The first turbine 22 may be a high-pressure turbine drivingly connected to a first impeller 28 of the combustion section 18 via a hollow first shaft 22 a collinear with the axis 12. The second turbine 24 may be a low-pressure turbine drivingly connected to a second impeller 30 of the compressor section 16 via a hollow second shaft 24*a*. The second shaft 24*a* extends coaxially inside the first shaft 22*a*. The power turbine 26 may be a two-stage power turbine drivingly connected to a propeller (not shown) disposed upstream of the inlet section 14 via a hollow third shaft 26*a*. The third shaft 26*a* extends coaxially inside the second shaft 24*a*. The first, second and third shafts 22*a*, 24*a*, 26*a* are rotatable relative to one another about the axis 12 of the engine 10 with their respective turbines.

Figure 2:
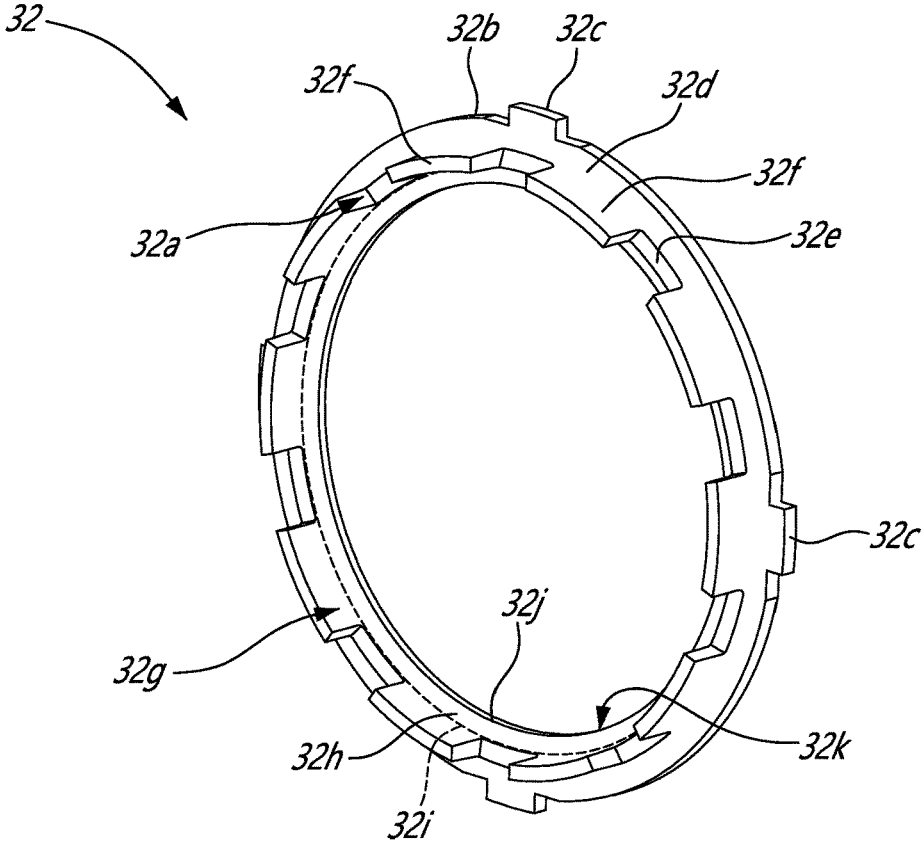
FIG. 2 is an isometric view taken from an upstream side of a key washer of a first turbine of the turbine section of FIG. 1.

A washer 32 of the first turbine 22 (in this case a key washer, characteristics of which will be described in more detail hereinbelow), is disposed along the axis 12 upstream of the second turbine 24. Referring to FIG. 2, the washer 32 is shown in more detail. The washer 32 has opposite upstream and downstream sides along a washer axis. The washer 32 has a first ring portion 32*a* surrounding the washer axis. In an embodiment, the washer axis is collinear or minimally offset from the axis 12 when the washer 32 is installed in the engine 10. The first ring portion 32*a* is circumscribed between an inner diameter and an outer diameter that lay in a plane to which the washer axis is normal. The washer 32 may be configured to rotationally engage with other components of the engine 10 via the first ring portion 32*a* upon rotation about the washer axis. For instance, the first ring portion 32*a* may have one or more anti-rotational features (i.e., first keying features) disposed about the washer axis. In this embodiment, the first ring portion 32*a* has an outer peripheral surface 32*b* from which first keys 32*c* of the washer 32 extend outwardly relative to the washer axis. The first keys 32*c* may have a shape complementary to that of a component of the engine 10 so as to be engageable therewith. The first keys 32*c* may be evenly spaced around the washer axis. In this embodiment, a total of four first keys 32*c* is provided, oriented radially relative to the washer axis and angularly spaced relative to one another by about 90 degrees. In other embodiments, the first keys 32*c* may be provided in different amounts, may be spaced otherwise, and may be oriented in ways other than substantially radially. In yet other embodiments, a sole first key 32*c* may be provided. It shall be understood that the first keys 32*c* define first keying features of the washer 32, i.e., anti-rotational features of the washer 32 configured to hinder rotation thereof about the washer axis relative to a first component of the engine 10 interfacing therewith. In some embodiments, anti-rotational features other than the first keys 32*c* may be used to hinder rotation, such as fasteners or other shapes which may adequately mesh with a corresponding complementary shape of the first component of the engine 10.

Further, the first ring portion 32*a* may have an annular ridge 32*d* disposed about the washer axis inward of the outer surface 32*b*. The annular ridge 32*d* may otherwise be flush with the outer surface 32*b*. The annular ridge 32*d* may have one or more anti-rotational features (i.e., second keying features) disposed about the washer axis. The annular ridge 32*d* may extend from an upstream surface of the first ring portion 32*a* oriented transversely to the outer surface 32*b* and in a generally axial direction, such as by being parallel to the washer axis. The annular ridge 32*d* may have a shape complementary to that of components of the engine 10 so as to be engageable therewith. For example, the annular ridge 32*d* may have a plurality of slots 32*e* disposed circumferentially such that a remainder of the annular ridge 32*d* forms a crenelated pattern facing away from the upstream side of the washer 32. In this embodiment, the slots 32*e* may be described as keying slots, and the remainder of the annular ridge 32*d* may be described as defining a plurality of second keys 32*f*. The slots 32*e* may be evenly spaced around the washer axis. For example, a total of ten slots 32*e* may be provided and be angularly spaced relative to one another by about 36 degrees. In other embodiments, the annular ridge 32*d* may be oriented in ways other than parallel. The slots 32*e* may be provided in different amounts and may be spaced otherwise. In yet other embodiments, a sole slot 32*e* may be provided. It shall be understood that the annular ridge 32*d* defines second keying features of the washer 32, i.e., anti-rotational features of the washer 32 configured to hinder rotation thereof about the washer axis relative to a second component of the engine 10 interfacing therewith. In some embodiments, anti-rotational features other than the slots 32*e* and the second keys 32*f* may be used to hinder rotation, such as fasteners or other shapes which may adequately mesh with a corresponding complementary shape of the second component of the engine 10.

It shall also be understood that the first and second keying features together form an anti-rotational feature of the washer 32 configured to hinder rotation of any one of the first component and the second component of the engine 10 relative to the other about the washer axis. In some embodiments, anti-rotational features other than the first and second keying features may be used to hinder rotation between components of the engine 10 interfacing with the washer 32.

The washer 32 has a deflector 32*g* forming a second ring portion inward the first ring portion 32*a* relative to the washer axis. As such, the first ring portion 32*a* may form an outer diameter of the washer 36 defined relative to the washer axis, and the deflector 32*g* may form an inner diameter of the washer 32 inward the outer diameter relative to the washer axis. The first ring portion 32*a* and the deflector 32*g* may be interconnected, such that the washer 32 forms a unitary piece. The unitary piece the washer 32 defines may be a monolithic body. In other embodiments, the first ring portion 32*a* and the deflector 32*g* may be separate components arranged to be attachable to one another or otherwise rotationally engageable relative to one another about the washer axis.

The deflector 32*g* has a deflector surface 32*h* facing upstream and configured to redirect a flow directed thereagainst. The deflector surface 32*h* is shaped to redirect the flow in a desired direction. The flow may for example be directed against the deflector surface 32*h* in a path generally parallel to the washer axis. The desired direction may for example be inward from the deflector 32*g*, i.e., away from the deflector 32*g* toward the washer axis. The annular ridge 32*d* and the deflector 32*g* may be successively disposed along the washer axis. The deflector surface 32*h* may have an upstream boundary 32*i* flush with an inner surface of the annular ridge 32*d* and extend therefrom to a downstream boundary 32*j* so as to ramp away from the annular ridge 32*d* of the first ring portion 32*a* toward the washer axis. For instance, a normal of the deflector surface 32*h* may be directed toward the washer axis at its upstream boundary 32*i*. The normal of the deflector surface 32*h* may be directed upstream and parallel to the washer axis at its downstream boundary 32*j*. At the downstream boundary 32*j*, the normal of the deflector surface 32*h* may otherwise be directed upstream at an angle relative to the washer axis. The angle may be for example 45 degrees. The deflector 32*g* has a deflector surface 32*k* opposite the deflector surface 32*h*. In this embodiment, the deflector surfaces 32*h*, 32*k* meet at the downstream boundary 32*j* so as to form a vertex of the deflector 32*g*. In other embodiments, the deflector surfaces 32*h*, 32*k* may be spaced away from one another.

Figure 3:
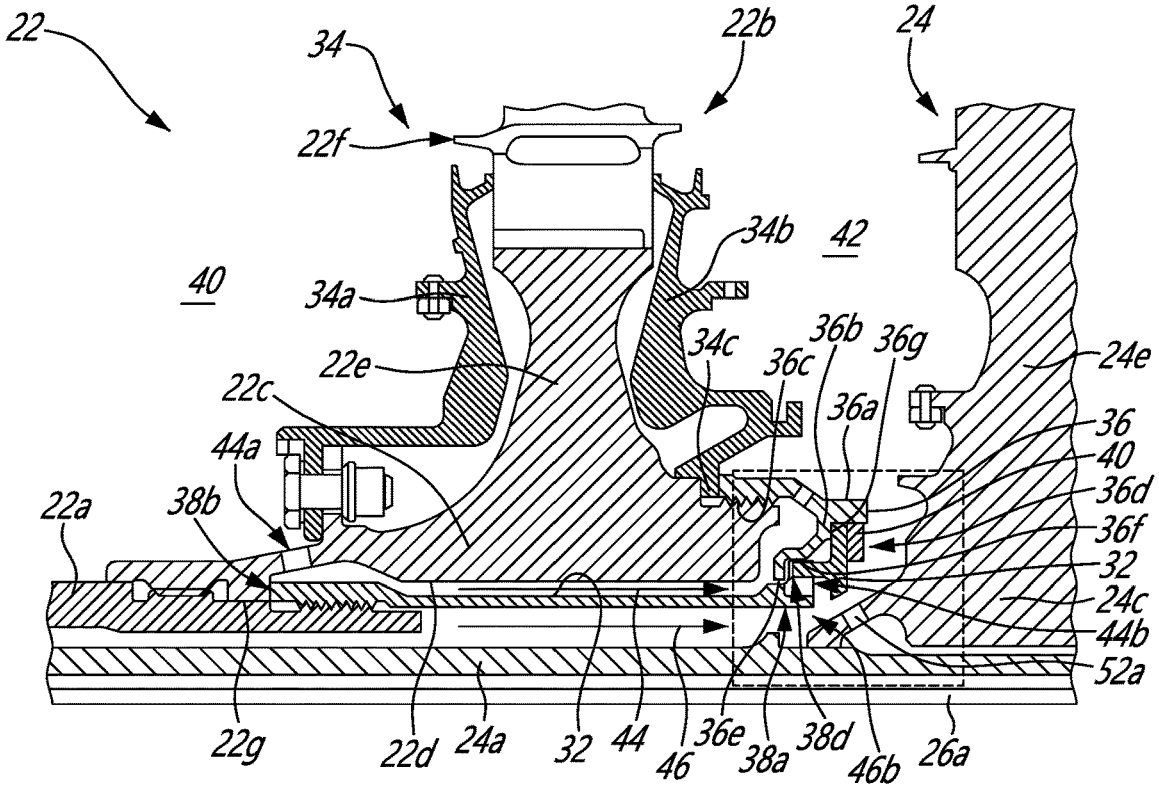
FIG. 3 is a schematic representation of a portion of the turbine section of the gas turbine engine of FIG. 1, showing a portion of the turbine section of the engine of FIG. 1 having the key washer of FIG. 2.

Referring to FIG. 3 the first turbine 22 is shown in more detail. The first turbine 22 may include a first disc 22*b*, the washer 32, disc covers 34, a first nut 36 and a second nut 38. The first disc 22*b* has a first hub defining opposite ends of the first disc 22*b*. The first hub 22*c* defines a first disc bore 22*d* between its opposite ends. A first web 22*e* extends generally radially from the first hub 22*c* to a blade 22*f* (not shown in detail) of the first disc 22*b*. An upstream hub portion is disposed around the first shaft 22*a* whereas a downstream hub portion is cantilevered relative to the first shaft 22*a*. An upstream cover 34*a* and a downstream cover 34*b* may be disposed on either sides of the first disc 22*b* and fastened to the upstream and downstream hub portions, respectively.

The first nut 36 is disposed downstream of the first disc 22*b* and joined thereto. For example, the first nut 36 may be fastened to the downstream hub portion of the first disc 22*b*. The first nut 36 has an outer, circumferential wall 36*a* and opposite upstream and downstream sides as delimited by a transverse nut wall 36*b*. Upstream and downstream outer bores 36*c*, 36*d* of the first nut 36 extend coaxially from either sides of the first nut 36 toward the transverse nut wall 36*b* thereof. An inner bore 36*e* of the first nut 36 coaxial with the outer bores 36*c*, 36*d* extends through the transverse nut wall 36*b*.

The first nut 36 is shown in a fastened position relative to the first disc 22*b*. A downstream end of the first hub 22*c* is received by the upstream outer bore 36*c*, to which the first nut 36 is fastened via threading. The downstream cover 34*b* and the first nut 36 may be successively disposed downstream of the first web 22*e* such that the downstream cover 34*b* is fastened to the first disc 22*b* by the first nut 36. The first nut 36 is screwed relative to the first hub 22*c* such that an annular flange 34*c* of the downstream cover 34*b* is held between the upstream side of the first nut 36 and a shoulder of the first hub 22*c*. The first nut 36 may be configured such that in the fastened position, the transverse nut wall 36*b* is spaced away from the downstream end of the first hub 22*c*.

The first nut 36 may be configured so as to be engageable with the washer 32 via its downstream side. For instance, the transverse nut wall 36*d* may be shaped so as to define a socket 36*f* at the bottom of the downstream outer bore 36*d* adjacent the inner bore 36*e*. The socket 36*f* may be sized for receiving the annular ridge 32*f* of the washer 32. The first nut 36 may have one or more first slots 36*g* disposed downstream of the socket 36*f* and outward from the downstream outer bore 36*d*. The one or more first slots 36*g* may have a shape complementary to that of the one or more first keys 36*c* of the washer 32 so as to be engageable therewith. The first nut 36 may be configured to engage with the washer 32 via the one or more first slots 36*g* upon rotation about the axis 12, to hence block rotation of the assembly. Any one of the first slots 36*g* of the first nut 36 may be engageable with any one of the first keys 32*c* of the washer 32.

The second nut 38 has a downstream nut portion 38*a* and an upstream nut portion 38*b* opposite the downstream nut portion 38*a*. The second nut 38 may be configured so as to interface with the first nut 36 via the downstream nut portion 38*a*. For example, the downstream nut portion 38*a* may have a periphery 38*c* having a shape generally matching that of the socket 36*f* of the first nut 36 so as to be receivable thereby. The periphery 38*c* may be circumscribed by a diameter greater than that of the inner bore 36*e* of the first nut 36. The upstream nut portion 38*b* may be circumscribed by a diameter lesser than that of the inner bore 36*e*. Thus, the second nut 38 may interface with the first nut 36 upon the upstream nut portion 38*b* being inserted through the inner bore 36*e* and upon the downstream nut portion 38*a* being received by the socket 36*f*.

The second nut 38 may be configured so as to be engageable with the washer 32 via its downstream nut portion 38*a*. For example, the second nut 38 may have an anti-rotational feature, such as one or more keys 38*d* inward of the periphery 38*c*. The one or more keys 38*d* may have a shape complementary to that of the one or more second keying features of the washer 32 so as to be engageable therewith. Any one of the keys 38*d* of the second nut 38 may be engageable with any one of the slots 32*e* of the washer 32.

The second nut 38 may be configured so as to be fastenable with the first shaft 22*a* via its upstream nut portion 38*b* upon its downstream nut portion 38*a* being disposed downstream of the first disc bore 22*d* and the first shaft 22*a* being disposed inside the first disc bore 22*d*. For example, the upstream nut portion 38*b* may be circumscribed by a diameter lesser than that of the first disc bore 22*a* and may have a length corresponding to a distance between opposite ends of the upstream and downstream hub portions. The second nut 38 is shown in a fastened position relative to the first shaft 22*a*, the first disc 22*a* and the first nut 36. In this position, the downstream nut portion 38*a* is received by the socket 36*f*. The second nut 38 extends from the downstream nut portion 38*a* through the inner bore 36*e* to its upstream nut portion 38*b* disposed inside the first disc bore 22*a*. The upstream nut portion 38*b* is fastened to the first shaft 22*a* via threading. The second nut 38 is screwed relative to the first shaft 22*a* such that an annular flange 22*g* of the upstream hub portion is held between an upstream side of the second nut 38 and a downstream-facing shoulder of the first shaft 22*a*. The second nut 38 is configured such that in the fastened position, the second nut 38 is coaxial with the first shaft 22*a* and the first disc bore 22*d*. The second nut 38 may also be configured such that a peripheral surface 38*e* upstream of its downstream portion 38*a* forms a gap 39 relative to the inner bore 36*e* of the first nut 36 upon the nuts 36, 38 being in their respective fastened positions, the gap 39 forming a portion of the first flow path 44 (e.g., of annular shape considering the annularity of the components defining the flow path 44). The nuts 36, 38 may be structured and arranged relative to one another such that dimensions of the gap 39 remain within desirable ranges despite thermal deformation occurring as the engine 10 is operated under certain conditions. As such, the gap 39 may be said to be a controlled gap.

The washer 32 is shown in an engaged position (i.e., in this case, a keyed position) relative to the first and second nuts 36, 38. In the engaged position, the washer 32 may be coaxial with the first and second nuts 36, 38 and the washer axis may be collinear with the axis 12 of the engine 10. Further, rotation of either the first nut 36 or the second nut 38 about the axis 12 relative to the first disc 22*b* may be blocked by the first and second nuts 36, 38 and the washer 32 being in the engaged position. Indeed, the threading which fastens the first nut 36 and the threading which fastens the second nut 38 may be of an opposite handedness. The washer 32 being rotationally engaged with both nuts 36, 38 may thus prevent the nuts 36, 38 from rotating about the axis 12 relative to the first disc 22*b*, either with one another or independently. Further, upon mounting the first disc 22*b* about the first shaft 22*a*, fastening the first nut 36 to the first disc 22*b*, and fastening the second nut 38 to the first shaft 22*a*, placing the washer 32 in the engaged position may block any movement between the first disc 22*b* and the first shaft 22*a*. The first disc 22*b*, the disc covers 34, and the nuts 36, 38 may be said to form a first turbine assembly, of which the washer 32 may block rotation relative to the first shaft 22*a* about the axis 12.

A retaining ring 40 may be disposed downstream of the washer 32 about the axis 12. The retaining ring 40 may be configured so as to hinder translation of the washer 32 along the axis 12 relative to the first nut 36. For example, upon the washer 32 being in the engaged position, the retaining ring 40 may be joined to the first nut 36 (for example via retention in a circumferential groove surrounding the downstream outer bore 36*c* or via friction) so as to retain the washer 32 in position relative to the first nut 36.

Still referring to FIG. 3, annular gaps in serial flow communication are formed around the second nut 38 relative to the first disc bore 22*a* and to the inner nut bore 36*e*, respectively. The annular gaps are in fluid communication with upstream and downstream interior spaces 40, 42 of the turbine section 20 via a first inlet 44*a* of the upstream hub portion and a first outlet 44*b* of the downstream nut portion 38*a*, defining a first flow path 44 of the first turbine 22 therebetween. The upstream interior space 40 is heated due to thermal energy transferred from the combustion section 18. As such, a first flow 44*c* (FIG. 4) of air flowed from the upstream interior space 40 and throughout the first flow path 44 is substantially hot.

The keys 38*d* of the second nut 38 may be disposed outward of the first outlet 44*b* relative to the axis 12 such that upon engagement of the one or more slots 32*e* therewith, the annular ridge 32*d* is clear of the first flow 44*c*. The keys 38*d* may be configured such that upon engagement of the one or more slots 32*e* therewith, the deflector 36*g* is positioned downstream of the first flow path 44 so as to faces the first flow 44*c*. The downstream nut portion 38*a* may be configured to rotationally engage with the washer 32 via the keys 38*d* upon rotation about the axis 12.

A second flow path 46 of the first turbine 22 is defined by annular gaps in serial flow communication formed around the second shaft 24*a* relative to an interior wall of the first shaft 22*a* and an interior wall of the second nut 38, respectively. The second flow path 46 is in fluid communication with an interior space of the compressor section 16 via a second inlet 46*a* (FIG. 1) and with the downstream interior space 42 via a second outlet 46*b*. The second outlet 46*b* is formed in part by the downstream nut portion 38*a* and located radially inward of the first outlet 44*b*. The interior space of the compressor section 16 being at a temperature generally greater than ambient temperature and lesser than a second impeller temperature downstream of the second impeller 30. Thus, a second flow 46*c* (FIG. 4) of air flowed from the compressor section 16 and throughout the second flow path 44 is generally colder relative to the first flow 44*c*. The second impeller temperature may for example be inside a diffuser conduit 30*a* in downstream serial flow communication with the second impeller 30. The interior space of the compressor section 16 may be heated up via the diffuser conduit 30*a* yet remain relatively cooler due to thermal losses via other adjacent media disposed between the compressor section 16 and an environment exterior to the engine 10.

Figure 4:
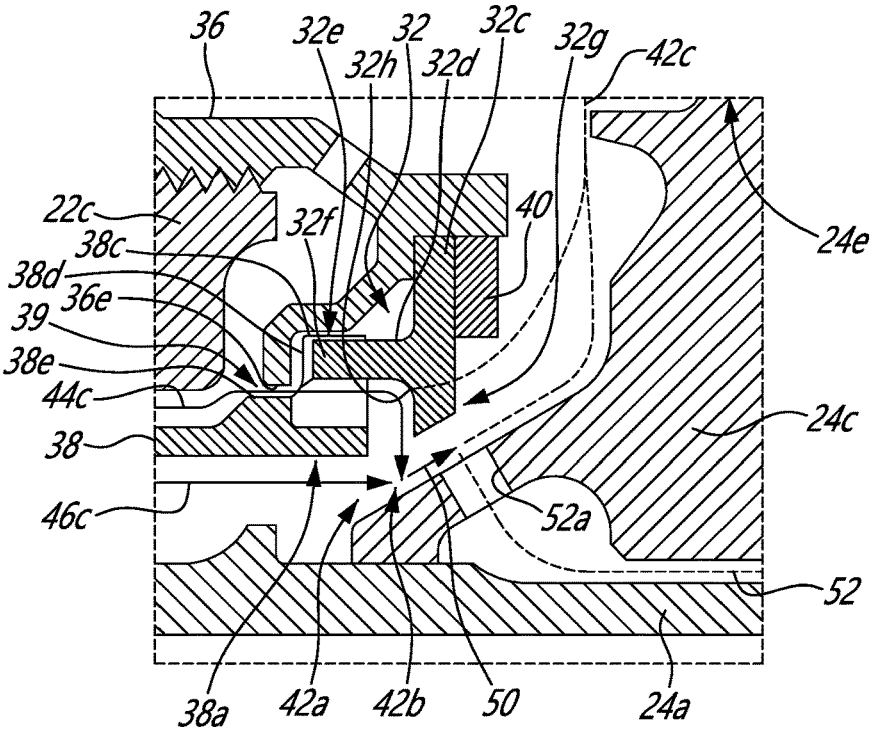
FIG. 4 is a close-up view of the portion of the turbine section of FIG. 3, schematically representing the key washer deflecting a first air flow toward a second air flow in a gap of the portion of the turbine section of FIG. 3.

Turning now to FIG. 4, a configuration of the washer 32 for redirecting the first flow 44*c* toward the second flow 46*c* will be described. A portion of the upstream interior space 42 located radially inward of the first hub 22*c* and of a second hub 24*c* of the second disc 22*b* defines a gap 42*a*. With the washer 32 in the engaged position, its deflector 32*g* is disposed inside the gap 42*a*. The washer 32 is configured such that, in the engaged position, the deflector 32*g* forms a third flow path in fluid communication with the first flow path 44*c* and directed toward the second flow path 46*c*. The deflector surface 32*h* is shaped to redirect a flow toward a desired location. Indeed, the upstream deflector surface 32*h* redirects the first flow 44*c* toward the second flow 46*c* such that the flows 44*c*, 46*c* cross at the desired location represented by intersection 42*b*. Deflection of the first flow 44*c* results in a mixed flow 50 flowing downstream from the intersection 42*b*. The mixed flow 50 has a temperature between that of the first and second flows 44*c*, 46*c*. Hence, thermal gradients in portions of the first and second turbines 22 located downstream of the intersection 42*b* may be desirably reduced upon exposure to the mixed flow 50. Reduction of thermal gradients and corresponding thermal stresses in such turbine components may, under certain circumstances, desirably increase a lifespan of such turbine components. Thus, the washer 32 is configured such that the intersection is located inside the gap 42*a* and upstream of some such turbine components. For example, in this embodiment, the washer 32 is configured such that the intersection 42*b* is located upstream of an inlet 52*a* of a fourth flow path 52 defined by the second turbine 24, such that a portion of the mixed flow 50 may flow through the fourth flow path 52.

Figure 5:
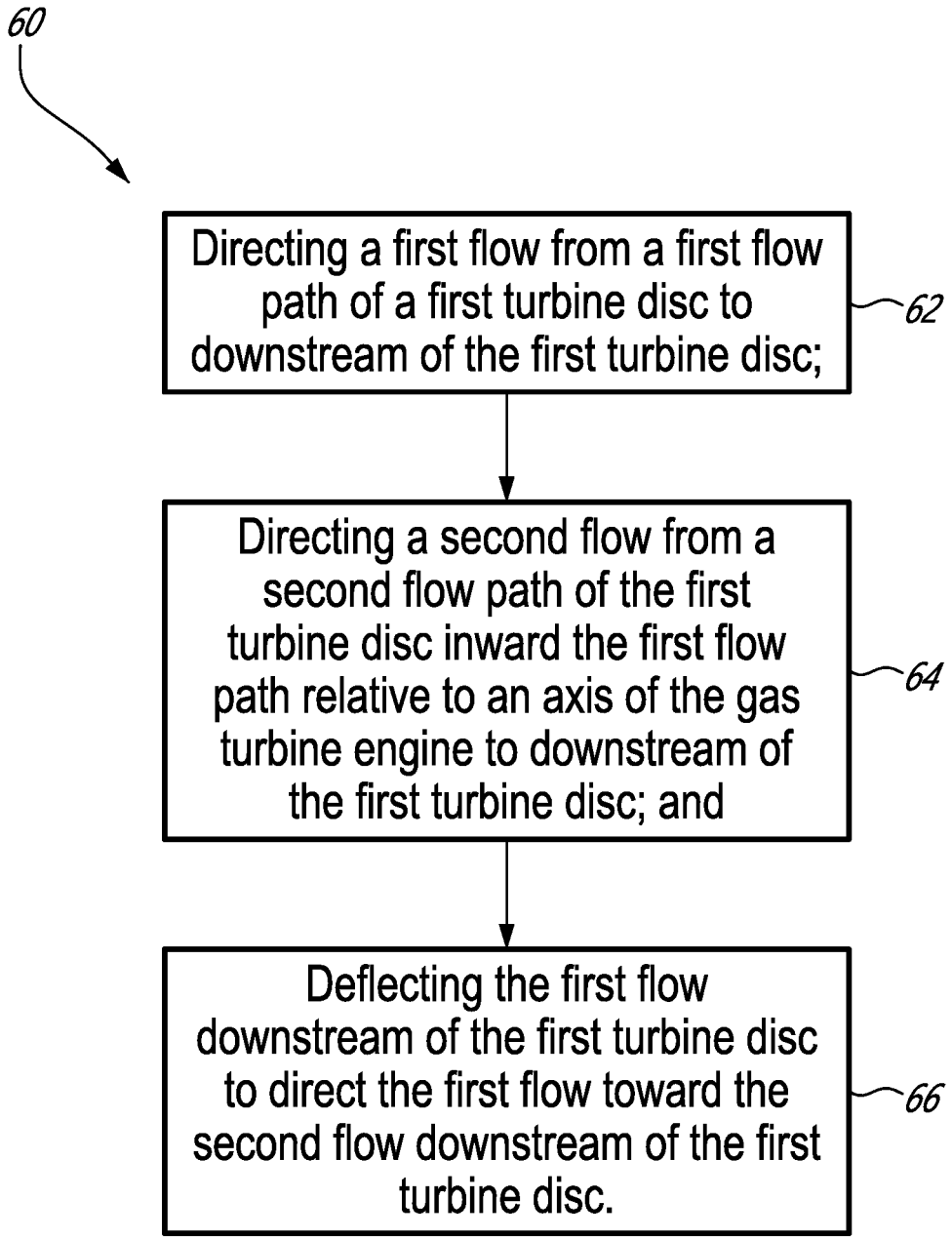
FIG. 5 is a flow chart of a method of deflecting flow in a gas turbine engine downstream of a turbine disc of the gas turbine engine using the key washer of FIG. 2.

With reference to FIG. 5 a method 60 of redirecting the first flow 44*c* in the gas turbine engine 10 will now be described.

The method 60 starts at step 62 with directing the first flow 44*c* from the first flow path 44 of the first turbine disc 22*b* to downstream thereof along the axis 12. In some embodiments, the method 60 may provide controlling at least one of a flow rate and a temperature of the first flow 44*c* upstream of the first turbine disc 22*b*. The flow rate and the temperature may respectively be controlled to be at a predetermined value or within a predetermined range of values.

From step 62, the method 60 goes to step 64 with directing the second flow 46*c* from the second flow path 46 of the first turbine disc 22*b* inward the first flow path 44 to downstream thereof along the axis 12. In some embodiments, the method 60 may provide controlling at least one of a flow rate and a temperature of the second flow 46*c* upstream of the first turbine disc 22*b*. The flow rate and the temperature may respectively be controlled to be at a predetermined value or within a predetermined range of values.

From step 64, the method 60 goes to step 66 with deflecting the first flow 44*c* downstream of the first turbine disc 22*b* to direct the first flow 44*c* toward the second flow 46*c* downstream of the first turbine disc 22*b*. In some embodiments, the method 60 may provide deflecting the first flow 44*c* upstream of the gap 42*a* prior to deflecting the first flow 44*c* downstream of the first turbine disc 22*b*.

In some embodiments, the method 60 further comprises mixing the first flow 44*c* and the second flow 46*c* into the mixed flow 50 at the intersection 42*b* located downstream of the first turbine disc 22*b* upon deflecting the first flow 44*c*.

In some such embodiments, the intersection 42*b* is located in the gap 42*a* defined between the first turbine disc 22*b* and the second turbine disc 24*b* downstream of the first turbine disc 22*b*. The intersection 42*b* may be located upstream of the inlet 52*a* of the flow path 52 defined by the second turbine 24.

In some embodiments, the method 60 further comprises placing a washer having a deflector such as the deflector 32*g* downstream of the first turbine disc 22*b* such that its deflector faces the first flow 44*c* to deflect the first flow 44*c*. In some such embodiments, the washer may have no first and second keying features such as the keys 32*c* and the slots 32*e* provided that the deflector remains positioned so as to face the first flow 44*c* to deflect the first flow 44*c* upon operating the engine 10.

In some embodiments, the method 60 further comprises placing the washer 32 downstream of the first turbine disc 22*b* such that the deflector 32*g* faces the first flow 44*c* to deflect the first flow 44*c*.

In some such embodiments, the method 60 further comprises removing an existing key washer from downstream of the first turbine disc 22*b* prior to placing the washer 32 downstream of the first turbine disc 22*b*. The existing key washer may have no deflector such as the deflector 32*g*, and may be keyed relative to the first turbine disc 22*b* and to the first shaft 22*a*.

In some embodiments, the method 60 further comprises controlling the deflection of the first flow 44*c* to redirect the first flow 44*c* from toward the location of the intersection 42*b* to toward a desired location downstream of the first turbine disc 22*b*. Thus, the first flow 44*c* and the second flow 46*c* may be mixed into the mixed flow 50 at the desired location. For example, one may control the deflection of the first flow 44*c* by replacing a first washer having a first deflector configured for directing the first flow 44*c* toward the location of the intersection 42*b* with a second washer having a second deflector configured for directing the first flow 44*c* toward the desired location.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A gas turbine engine comprising:

a shaft about an axis;

a first turbine assembly mounted to the shaft, a first flow path and a second flow path extending through first turbine assembly along the axis, the second flow path located radially inward of the first flow path relative to the axis;

a second turbine assembly about the axis downstream of the first turbine assembly, with a gap defined between the first turbine assembly and the second turbine assembly, the gap in fluid communication with the first flow path and the second flow path; and a washer downstream of the first turbine assembly, the washer having an annular body including a deflector between the first turbine assembly and the second turbine assembly, the deflector obstructing the first flow path and extending toward the second flow path.

2. The gas turbine engine of claim 1, wherein the washer has an outer ring portion configured to hinder rotation of the shaft and the first turbine assembly relative to one another about the axis, the deflector forming an inner ring portion of the washer inward the outer ring portion relative to the axis.

3. The gas turbine engine of claim 2, wherein the outer ring portion and the inner ring portion form a monolithic body.

4. The gas turbine engine of claim 2, wherein the first turbine assembly includes a first disc about the axis, a first nut fastened to the first disc about the axis and a second nut fastened to the shaft about the axis, the outer ring portion engaging with the first disc via the first nut and with the first shaft via the second nut to hinder the rotation about the axis.

5. The gas turbine engine of claim 3, wherein the second nut extends inside the first disc along the first flow path to downstream of the first nut, an outlet of the first flow path defined in the second nut inward of the first nut relative to the axis, the deflector extending from outward to inward of the outlet of the first flow path relative to the axis.

6. The gas turbine engine of claim 1, wherein the deflector is shaped so as to form a third flow path in fluid communication with the first flow path, the third flow path directed from the first flow path toward the second flow path.

7. The gas turbine engine of claim 6, wherein a fourth flow path in fluid communication with the gap extends downstream therefrom along the axis, the third flow path directed to upstream of the fourth flow path.

8. The gas turbine engine of claim 7, wherein the fourth flow path is located inward of the first flow path relative to the axis, the third flow path intersecting with the first flow path at an intersection located inward of an outlet of the fourth flow path relative to the axis.

9. A method of redirecting a flow in a gas turbine engine, the method comprising:

directing a first flow through a first flow path of a first turbine disc along an axis of the gas turbine engine;

directing a second flow through a second flow path of the first turbine disc inward the first flow path relative to the axis, and along the axis; and deflecting the first flow downstream of the first turbine disc to direct the first flow toward the second flow downstream of the first turbine disc.

10. The method of claim 9, further comprising mixing the first flow and the second flow into a mixed flow at an intersection located downstream of the first turbine disc upon deflecting the first flow.

11. The method of claim 10, wherein the intersection is located in a gap defined between the first turbine disc and a second turbine disc downstream of the first turbine disc.

12. The method of claim 11, wherein the intersection is located upstream of an inlet of a flow path defined through the second turbine disc.

13. The method of claim 9, further comprising placing a washer downstream of the first turbine disc such that a deflector of the washer faces the first flow to deflect the first flow.

14. The method of claim 13, wherein placing the washer includes replacing an existing key washer downstream of the first turbine disc that is keyed relative to the first turbine disc and to the first shaft with the washer.

15. A washer for a gas turbine engine, the washer comprising:

a first ring portion includes an annular ridge extending from an upstream surface of the first ring portion along a washer axis;

at least one first keying feature extending outwardly from a peripheral surface of the first ring portion;

at least one second keying feature of the annular ridge extending from the upstream surface of the first ring portion transverse to the peripheral surface; and a second ring portion radially inward of the first ring portion, the second ring portion defining a deflector surface transverse to the washer axis, the deflector surface having an upstream boundary flush with the annular ridge and extending from the upstream boundary to a downstream boundary so as to ramp away from the annular ridge toward the washer axis, the downstream boundary of the deflector surface forming an apex of the deflector surface.

16. The washer as claimed in claim 15, wherein the washer has a monoblock body.

17. The washer as claimed in claim 15, comprising a plurality of the at least one first keying feature.

18. The washer as claimed in claim 15, comprising a plurality of the at least one second keying feature.

* * * * *